US005565879A

United States Patent [19]

Lamensdorf

[11] Patent Number: 5,565,879

[45] Date of Patent: Oct. 15, 1996

[54] HIGH SCAN RATE LOW SIDELOBE CIRCULAR SCANNING ANTENNA

[75] Inventor: David Lamensdorf, Arlington, Mass.

[73] Assignee: Unisys Corporation, Blue Bell, Pa.

[21] Appl. No.: 134,393

[22] Filed: Mar. 26, 1980

[51] Int. Cl.[6] ..... H01Q 13/00

[52] U.S. Cl. ..... 343/781 R

[58] Field of Search ..... 343/799, 780, 343/781 R, 896, 897, 909, 854, 100 SA

[56] References Cited

U.S. PATENT DOCUMENTS 3,775,773 11/1973 Nemit ..... 343/781

*Primary Examiner*—Theodore M. Blum

*Attorney, Agent, or Firm*—Seymour Levine; Mark T. Starr

[57] ABSTRACT

An antenna for inertialess scanning a beam through 360 degrees or any desired sector thereof. A reflector, in the shape of a truncated cone that is tangential to an imaginary sphere in the central plane of the cone, is positioned above a feed array located in the equatorial plane of the sphere. The feed array is fed by a network with a plurality of input ports, each of which corresponds to a beam in space. By successively energizing these input ports the beam is caused to scan continuously over the desired sector.

8 Claims, 5 Drawing Sheets

FIG.6.
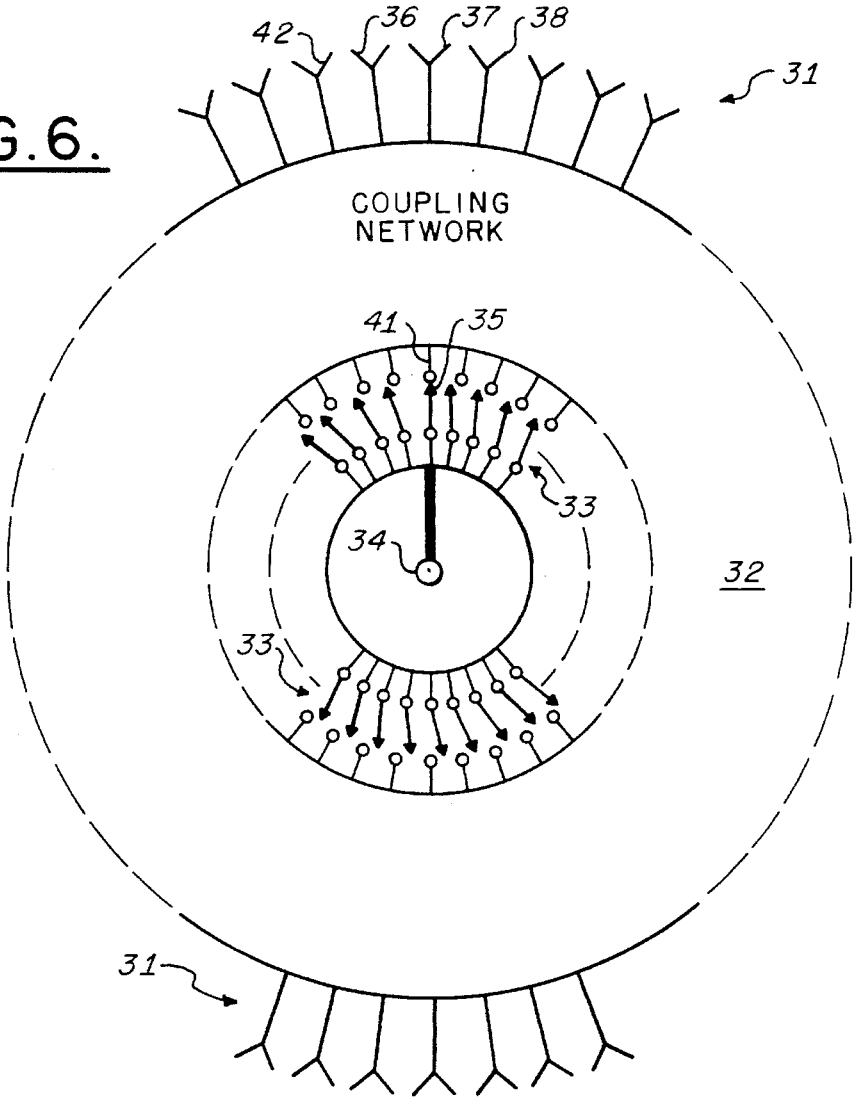
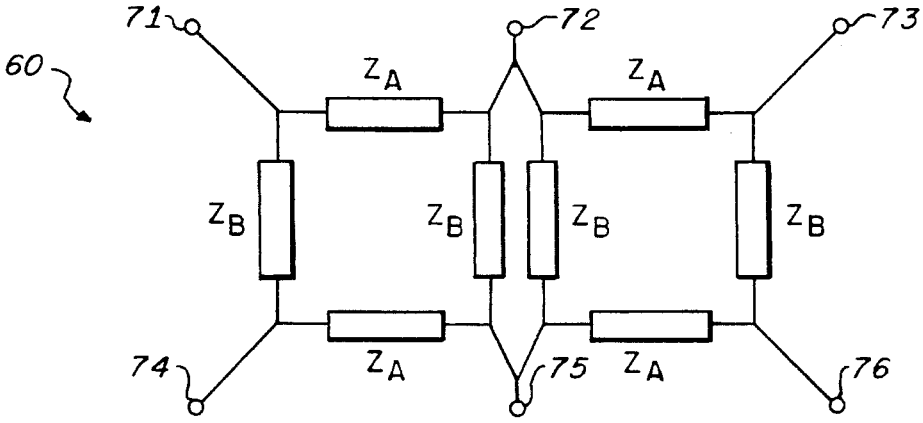
$$\left|\frac{V_{71}}{V_{75}}\right| = \left|\frac{V_{73}}{V_{75}}\right| = \sqrt{2R} = \frac{Z_B}{Z_A} = \sqrt{1 - Z_B^2}$$
$$Z_B^2 + Z_A^2 Z_B^2 = Z_A^2$$
FIG.8.

HIGH SCAN RATE LOW SIDELOBE CIRCULAR SCANNING ANTENNA

BACKGROUND OF THE INVENTION

1. Field of the Invention

The present invention relates to scanning antennas and more particularly to antennas capable of circularly scanning a high directivity low sidelobe beam.

2. Description of the Prior Art

Many radar systems require radiation beams with broad elevation beamwidths and narrow azimuth beamwidths which are azimuthally scannable over 360 degrees. These radiation characteristics have been achieved with various antenna designs, one of which is the mechanical rotation of an entire antenna assembly comprising a large parabolic cylinder reflector and a feed system therefor. These are high inertial systems, however, requiring considerable driving power and providing maximum scan rates in the order of 25 rpm. An antenna capable of providing a fan beam rapidly scannable in the azimuthal plane, is disclosed in U.S. patent application Ser. No. 918,182, filed by Cronson et al on Jun. 22, 1978 and assigned to the Sperry Corporation. The antenna disclosed by Cronson et al includes a stationary transreflector, which may be an annulus of a spherical or parabolic torus, the surface of which is constructed of reflecting metal rods that are oriented at 45 degrees with respect to the meridians of the torus and a feed system that illuminates successive sections of the annulus as it rotates about the focal circle thereof. This rotating feed system produces an illumination pattern that is shaped to minimize spillover and radiates with a polarization vector that is parallel to the illuminated reflecting rods. Though providing significant improvement over the prior art with respect to scan rate and beam shape, the antenna disclosed by Cronson et al requires mechanical rotation of the feed and thus exhibits a limitation on the maximum scan rate achievable. Additionally, this antenna is limited with respect to the achievable sidelobe level in the azimuth plane. The sidelobe level may be improved with the utilization of a plurality of appropriately weighted radiating elements in the feed system. This, however, increases the inertia of the feed system and further limits the azimuthal scan rate.

The present invention is directed to an improved circularly scanning antenna with a scan rate capability significantly higher than those achieved by the antennas of the prior art and in which a plurality of radiating elements is utilized in the feed system to achieve low sidelobe levels over an entire 360 degree scan range.

SUMMARY OF THE INVENTION

A scanning antenna system in accordance with the present invention includes a stationary transreflector which may be an annulus of a sphere or of a parabolic torus, approximated by a truncated cone tangent to either surface of revolution at the center thereof. The surface of the transreflector comprises reflecting rods that are oriented at 45 degrees to the axis of the truncated cone. A feed system, comprising a circular array of radiating elements, located in that section of the equatorial plane of the sphere or torus that is a focal region for the truncated cone, selectively illuminates internal sections of the truncated cone with electromagnetic signals that are polarized parallel to the reflecting rods to which they are incident. These electromagnetic signals are thereafter reflected to propagate across the interior of the cone along paths perpendicular to the cone axis. With the cone constructed as previously described, the signals reflected from the initially illuminated rods are polarized perpendicularly to the rods diametrically positioned from the initially illuminated rods and propagate therethrough. As successive sections of the truncated cone are illuminated, successive beams are formed in space thereby providing a continuously scanned beam over a full 360 degree scan sector. Since the elements of the array in the focal region are stationary with electromagnetic energy successively coupled thereto, an inertialess scan system is provided that is capable of achieving extremely rapid scan rates. For applications which require a scan beam over a limited scan angle, the sections of the truncated cone diametrically opposite to the required illuminated region, and non-illuminated regions, may be removed as may all elements of the feed array not required for the illumination of the desired sector. The remaining structure of the truncated cone may be constructed of a solid reflecting material. With this configuration a system may be provided for scanning a preselected sector.

In many applications, radiated beams with sidelobe levels appreciably lower than that achievable by illuminating the required sector with a single feed element may be required. For these applications, a feed network is included that couples signals to three adjacent elements in the feed array of required relative amplitude and phase for the sidelobe level desired. This network is so constructed such that only one element in the array is added and dropped as the system commutably couples electromagnetic signals from one input port to an adjacent input port. Thus, providing a rapidly scanned beam with continuous coverage over the desired sectors. Other features and advantages of the invention will become apparent from the following detailed description.

BRIEF DESCRIPTION OF THE DRAWINGS

FIG. 6 is a schematic diagram of the feed array system.

FIG. 8 is a schematic diagram of a section of the feed network of FIG. 7.

DESCRIPTION OF THE PREFERRED EMBODIMENTS

Figure 1:
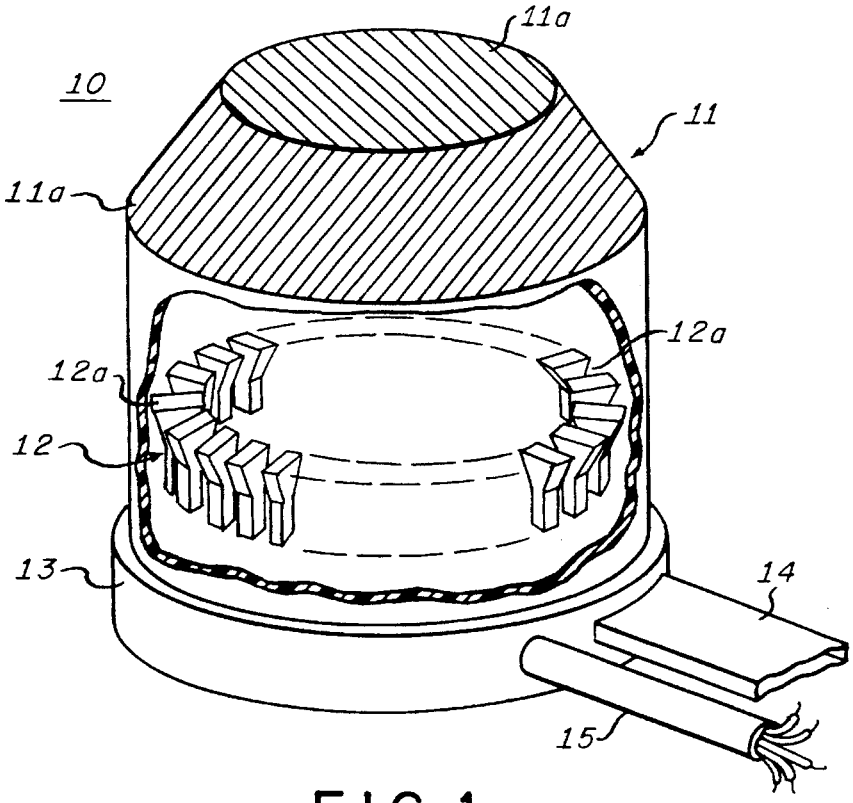
FIG. 1 is a three-dimensional view showing the truncated cone transreflector and the feed array configuration for a 360 degree scanning antenna in accordance with this invention.
Figure 2:
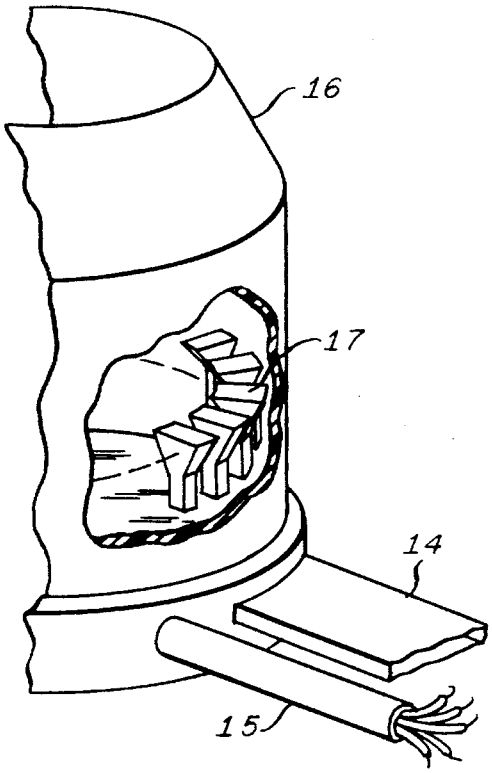
FIG. 2 is a three-dimensional view showing a sectored truncated cone reflector and a feed configuration for a limited scan antenna in accordance with this invention.

Referring to FIG. 1, the principal components of a 360 degree scanning antenna 10 may include a transreflector 11 and a feed system comprising a feed array 12 coupled to a distribution network 13 which switchably couples electromagnetic signals from input transmission line 14 to selected elements in the feed array 12 in response to commands transmitted via command cable 15. A limited scan version of the antenna shown in FIG. 1 is shown in FIG. 2 wherein a section of the transreflector 16, which may be a solid metallic sheet, is utilized with a corresponding section of the feed array 17. The operation of the limited scan antenna is similar to that of the 360 degree scan antenna as will become apparent in the discussion to follow.

Transreflector 11 may be a truncated cone approximation to an annulus of a sphere, with the central circle of the truncated cone tangential to the sphere at a selected elevation. The surface of the truncated cone may comprise reflecting rods 11a, arranged to form an angle of 45 degrees with the axis of the cone. Each element 12*a* in the feed array 12 may be positioned in the equatorial plane of the tangential sphere, in a manner yet to be described and may be of the type disclosed in U.S. patent application Ser. No. 918,182, filed by Cronson et al on Jun. 22, 1978 and assigned to Sperry Corporation. Each element 12*a* when excited by electromagnetic energy emits a signal with a polarization that is parallel to the illuminated rods. This signal is reflected from the illuminated rods, propagates across the inner region of the truncated cone to the diametrically positioned reflecting rods which are perpendicularly oriented to the polarization of the propagating signal, thus allowing the signal to propagate therethrough. By successively exciting each of the elements 12*a* in the feed array, a 360 degree scan beam may be obtained. If each radiating element produces a beam with an azimuthal beam width of θ degrees, N=360/θ feed elements may be positioned in a focal circle in an equatorial plane of the tangential sphere with uniform spacing therebetween. When 360/θ is not an integer, N is chosen as the next higher integer of the ratio. The beam may be electronically scanned with the utilization of a diode switching matrix which successively couples the electromagnetic signals to the elements of the feed array 12 or by successively energizing solid state transceiver modules coupled to each element.

Figure 3:
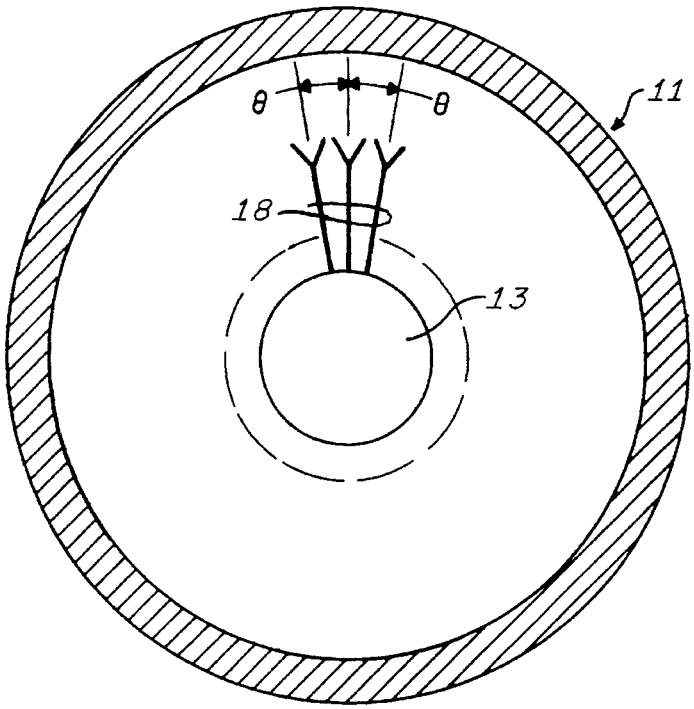
FIG. 3 is a plan view of a transreflector with a three element feed array in the focal region thereof, useful for explaining the sidelobe reduction technique employed in this invention.
Figure 4:
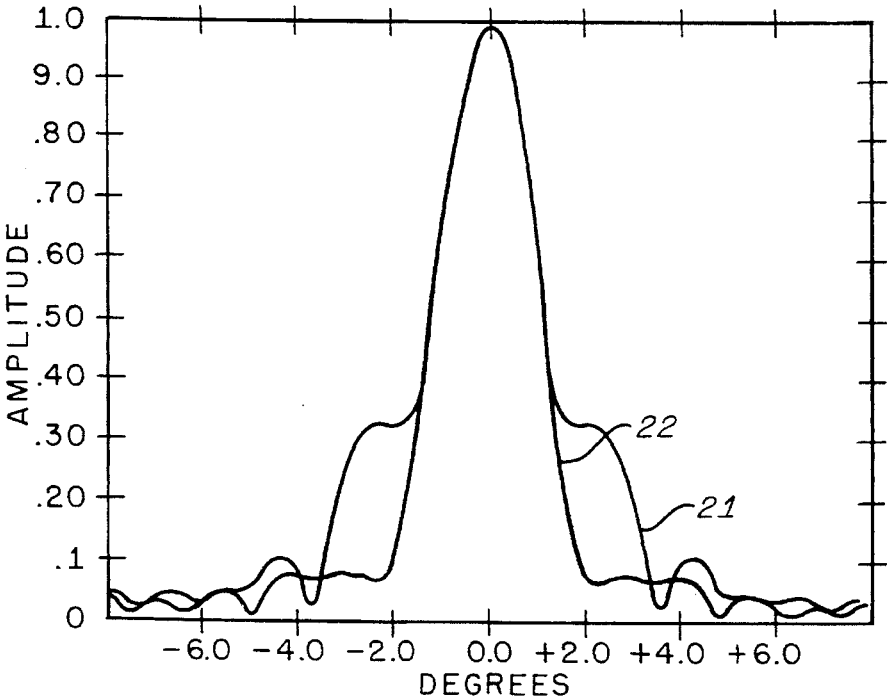
FIG. 4 illustrates the beam patterns for a single element feed and for a three element feed for sidelobe reduction for a truncated cone with a cone angle of 25.5 degrees and a sphere radius of 35 $\lambda$.

Many applications exist which require sidelobe levels that are lower than the sidelobe levels achievable by illuminating the transreflector with a single element. Sidelobe reduction may be accomplished by appropriately. spacing and exciting a plurality of elements in the feed array as, for example, the cluster 18 of three shown in the schematic plan view in FIG. 3. With the elements angularly spaced in the focal plane a beam width apart and properly amplitude and phase weighted, a desired apertured distribution function may be approximated and concomitantly a low sidelobe radiation pattern may be obtained. FIG. 4 shows a calculated pattern for a single horn feed 21 and a calculated pattern for a three horn feed 22. These patterns were computed with the utilization of the following assumptions: exponential feed element patterns representable by $f(\emptyset)=e^{-0.0001\emptyset^2}$; transreflector radius of 33λ; a cone angle of 25.5λ; the feed aperture located 15.8λ below the central plane of the transreflector; an angular feed element separation of 1.8 degrees; and an excitation for the two outside elements in the cluster of three relative to the central element of 0.2 −50°. It is readily seen from FIG. 4 that a significant improvement in the sidelobe level of the antenna may be achieved with the utilization of the cluster of feed elements.

Figure 5:
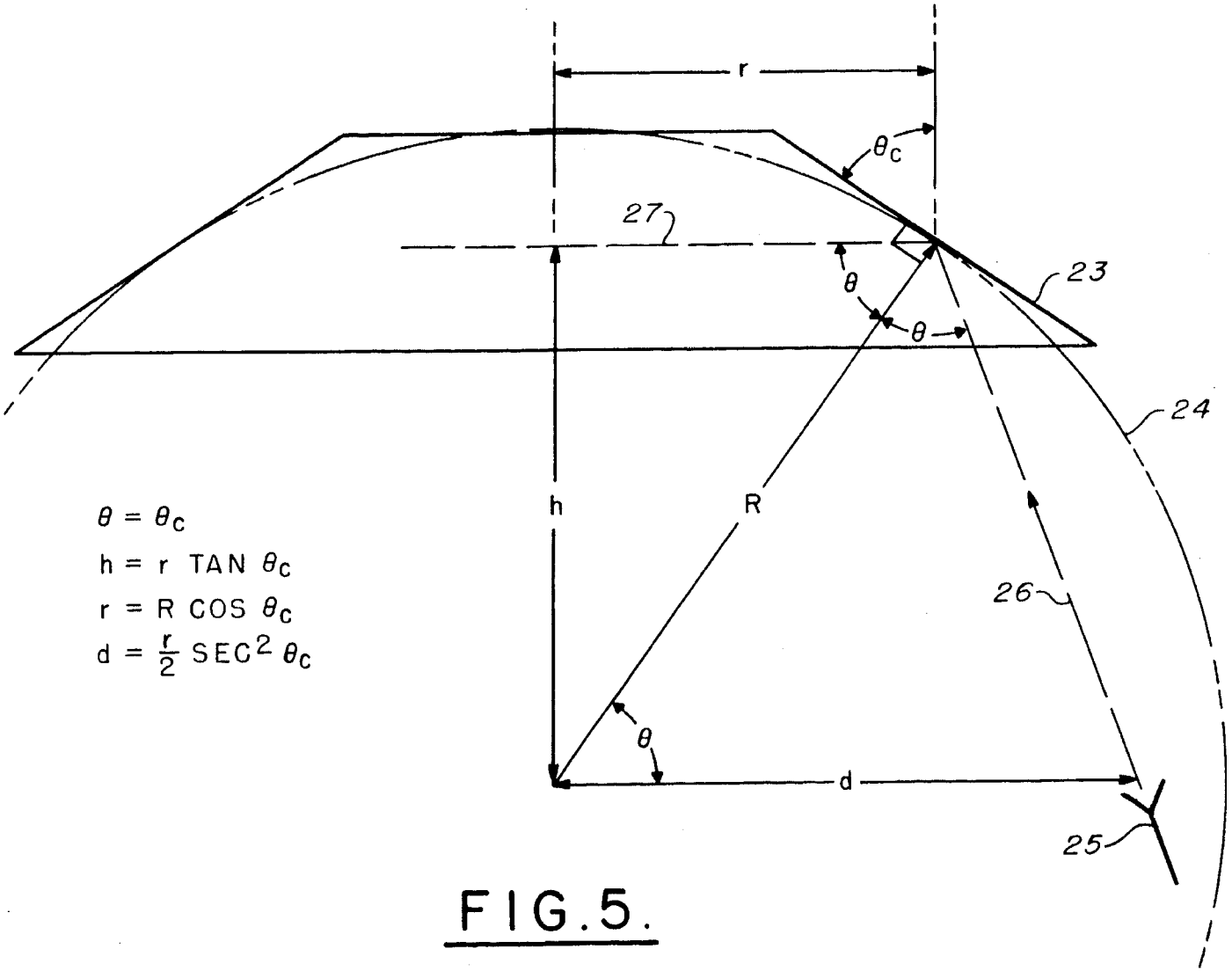
FIG. 5 is an illustration of the geometry of the transreflector and the positioning of a feed element therefor.

Refer now to FIG. 5 wherein the geometry of a transreflector 23, tangential in its central plane to an imaginary sphere 24, with a feed element 25, positioned substantially in the equatorial plane of the sphere 24, is shown. It is desirous for a ray, as for example the ray 26 from the feed element 25 incident to transreflector 23 in its central plane (point of tangency with the imaginary sphere 24) to be reflected along the path 27 in the central plane of the truncated cone. Since the radius R of the sphere 24 is perpendicular to the cone of the transreflector at the point of tangency, the angles formed by the radius with the ray paths 26 and 27 are, in accordance with Snell's Law, equal as shown in the figure and identified therein by θ. A geometrical analysis of the figure reveals that θ is the elevation angle of the tangent circle and is equal to the cone angle of $\theta_c$ and that the height h of the central plane of the trans-reflector 23, the radius r of the transreflector in the central plane, the radius R of the imaginary sphere, and the distance d of the feed from the center of the imaginary sphere are related by the trigonometric functions shown in FIG. 5. Since the transreflector 23 is circularly symmetric d represents the radius of.,the circle in which the elements of the feed array may be positioned to provide a radiated beam in the central plane of the transreflector 23 over all scan angles.

Refer now to FIG. 6 which is a schematic diagram including the circular feed array 31, coupling network 32 and switching array 33. Electromagnetic energy coupled to input port 34 is distributed to the input ports of each of the switches in switching array 33, each of which are single pole, single throw switches. In operation, only one switch is to be closed at any instant of time. These switches may be of the diode type and include diodes such as CSA 7205 as manufactured by Alfa Industries of Woburn, Mass. Each switch, when closed, will distribute the electromagnetic signal coupled thereto from the input port 34 between three elements of the circular feed array with the proper phase and amplitude distribution for the desired beam in space. As, for example, with switch 35 closed, elements 36,37 and 38 will be so excited. When switch 35 is opened, and the adjacent switch 41 is closed, no energy will be coupled to element 38 and the distribution will be between elements 42, 36 and 37. As each switch is opened, and the succeeding switch closed, the right external element of the trio of elements in the array is replaced by an external element to the left and the beam is scanned one beam position. This sequence of events continues for the full 360 degree scan. Though the system has been described as a left rotating beam, it should be apparent that by reversing the rotation of the switching sequence a right rotating beam may be provided.

Figure 7:
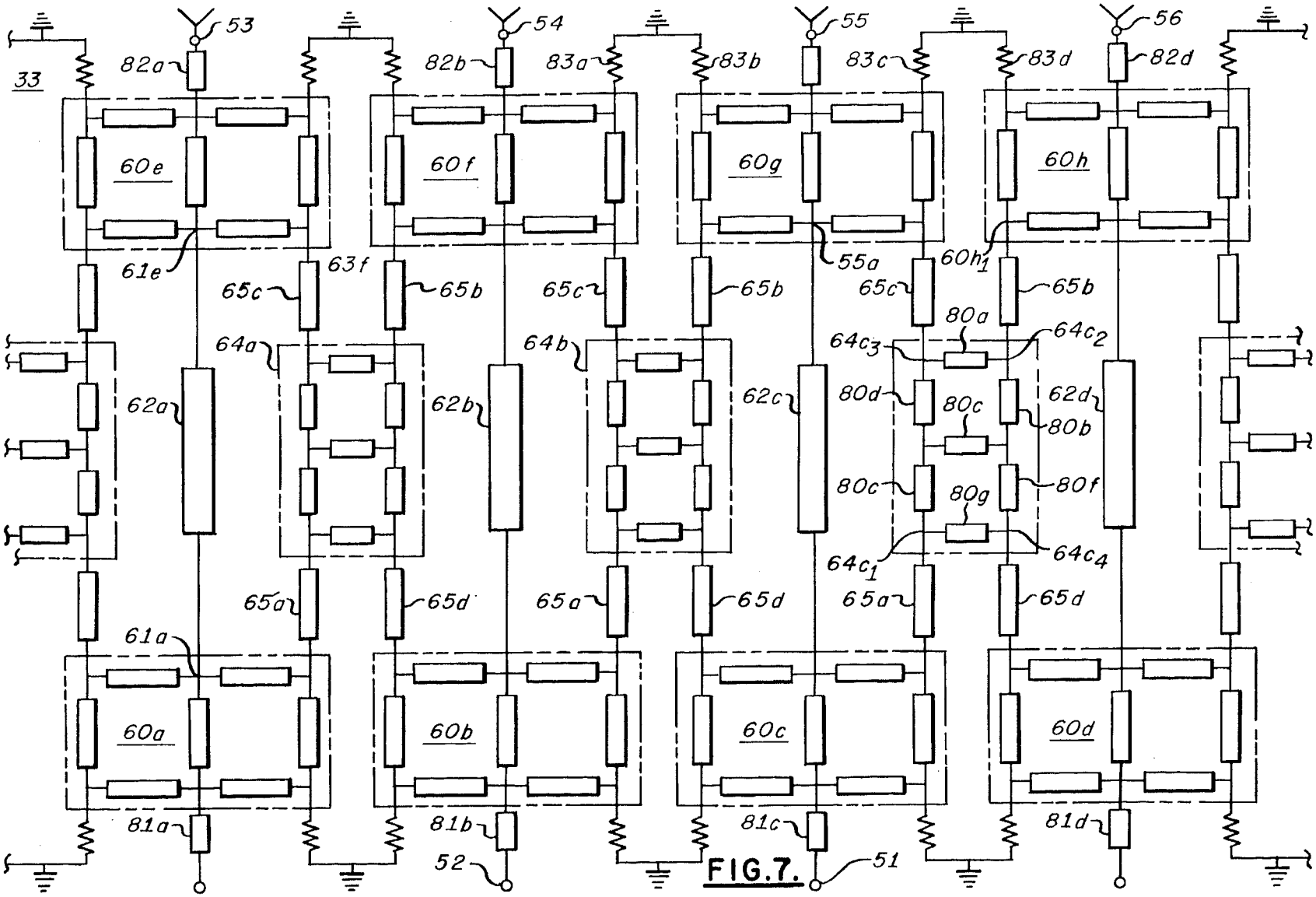
FIG. 7 is a schematic diagram of the feed network for the feed array system of FIG. 6.

Refer now to FIG. 7 wherein a partial schematic diagram of the distribution network 33 is shown. Assume a signal is coupled to input port 51. This signal will propagate through the network and be distributed with the desired phase and amplitude distribution between the output ports 54,55 and 56. Due to the symmetry of the network, when the input signal is switched from the input port 51 to an adjacent input port 52, the signal will be distributed by the network with the proper phase and amplitude distribution between output ports 53, 54 and 55. The network comprises a multiplicity of substantially identical six port input networks, four of which, 60*a* through 60*d*, are shown and a multiplicity of substantially identical six port output networks, four of which, 60*e* through 60*h*, are shown. The input and output networks are also substantially identical. These input and output networks are arranged in pairs and coupled at internal terminals, as for example 61*a* to 61*e*, via substantially identical transmission lines, as for example 62*a* through 62*d*. Each input network is coupled to an output network of an adjacent pair at external terminals, as for example 63*a* to 63*f*, via substantially identical coupling networks 64*a* through 64*c* and substantially identical transmission lines 65*a* through 65*d*.

Refer to FIG. 8, wherein is shown a six port 60 comprising two adjacent four port networks coupled in parallel. All of the line lengths of the network are λ/4 and all of the impedances $Z_A$ and $Z_B$ are normalized to one ohm. The two impedances in parallel between the central terminals of the six port may be combined to form an impedance $Z_c=Z_{B/2}$. If the impedances looking into the network at the external terminals 71,73,74 and 76 are each one ohm, then the impedance looking into the network to the two internal terminals 72 and 75 are each 0.5 ohms. Assume the signal is coupled to port 75 and it is desired that the power ratios $P_{73}/P_{75}=P_{71}/P_{75}=R$ and $P_{72}/P_{75}=T$. Since it is assumed that the network 60 comprises two biconjugate networks in parallel $P_{74}=P_{76}=0$. Consequently, since the network is also assumed lossless $$T+2R=1$$

Refer again to FIG. 7 and assume that signals with a power $P_{51}$ is coupled to the input terminal 51. This causes a signal with a power $TP_{51}$ to be coupled via the lossless transmission line 62*c* to the input terminal 55*a* of the output network 60*d* and therefrom a signal with a power $T^2P_{51}$ will be coupled to the output terminal 55 With a signal having a power level of $P_{51}$ coupled to the input terminal 51, a signal with a power level of $RP_{51}$ will be coupled, via transmission line 65*a*, to the input terminal 64*c*$_1$ of the coupling network 64*c*. The coupling network 64*a* through 64*c* is described by Reed and Wheeler in an article "A Method of Analysis of Symmetrical Four Port Networks", which appeared in the IRE Transactions, MT-4, October 1956 on pages 246–252. All of the transmission lines 80*a* through 80*d* are a quarter wave length long and have a normalized characteristic impedance of unity. A signal coupled to an input port of this network, as for example input 64*c*$_1$, will be coupled to a diagonal output port, as for example 64*c*$_2$, unattenuated but phase shifted by 90 degrees with no energy being coupled to the two remaining ports 64*c*$_3$ and 64*c*$_4$. Thus, a signal with a power level of $RP_{51}$ is coupled from port 64*c*$_2$ via transmission line 65*b* to an input port 60*h*$_1$ of the output network 60*h*.

Refer again to FIG. 8. Since the input power at port 75 is equally split between the two parallel networks, to achieve a signal with a power level of $RP_{75}$ at port 73, the power coupling coefficient between ports 75 and 73 and ports 75 and 71 must be 2R. Consequently, a signal coupled to input port 60*h*$_1$ in FIG. 7 will be coupled to output port 56 with the coupling coefficient 2R and the power level thereat will be $2R^2P_{51}$. Since the network is symmetrical about the axis between port 55 and 51, the power level of the signal coupled to output port 54 is also $2R^2P_{51}$. Thus, the ratio M of the powers at ports 54, 55 to the power at port 56 is:

$$\frac{P_{54}}{P_{56}}=\frac{P_{55}}{P_{56}}=M=\frac{2R^2}{T^2}=\frac{2R^2}{(1-2R)^2}$$

from which the coupling coefficient R may be determined to be:

$$R=\frac{\sqrt{M/2}}{1+2\sqrt{M/2}}$$

Referring again to FIG. 8, the voltage coupling coefficient between input port 75 and the diagonal output ports 71 and 73 is given:

$$\left|\frac{V_{71}}{V_{75}}\right|=\left|\frac{V_{73}}{V_{75}}\right|=\sqrt{2R}$$

Utilizing the design procedure presented by Reed and Wheeler, the characteristic impedances of the transmission lines may be determined from $$\sqrt{2R}=\frac{Z_B}{Z_A}=\sqrt{1-Z_B^2}$$

where:

$$Z_B^2+Z_A^2Z_B^2=Z_A^2$$

Each of the parallel networks in FIG. 8 are matched at all ports to the normalized impedance of one ohm. Consequently, to maintain this match, transmission lines with normalized characteristic impedances of one ohm must be coupled to ports 71, 73, 74 and 76 while transmission lines with normalized characteristic impedances of 0.5 ohms must be coupled to ports 72 and 75. Thus, in FIG. 7, coupling transmission lines 62*a* through 62*d*, the input transmission lines 81*a* through 81*d* and the output transmission lines 82*a* through 82*d* have normalized characteristic impedances of 0.5 ohms while the coupling transmission lines 65*a* through 65*d* have normalized characteristic impedances of one ohm.

Transmission lines 62*a* through 62*d* and all of the transmission lines 64*a* through 65*d* are, as stated previously lossless, and do not affect the magnitude of the coupling coefficients specified above, affecting only the phase distribution of the signal. Since signals are coupled from port 75 to ports 71 and 73 in phase and from port 75 to port 72 with a 90 degree phase lag and signals are coupled across the coupling networks 64*a* through 64*d* with a 90 degree phase advance, the phase difference $\emptyset$ between the signal coupled to output port 55 and the signals coupled to output ports 54 and 56 is:

$$\emptyset=L-2S-90°$$

where

L=electrical length of transmission lines 62*a* through d in degrees.

S=electrical length of transmission lines 64*a* through 64*d* in degrees.

It should be apparent to those skilled in the art that the ratio of the total signal power coupled to output ports 54,55 and 56 to the total signal power coupled to input port 51 is $1-(4R-8R^2)$. If the network were lossless, this ratio would be unity. Consequently, a loss of $4R-8R^2$ is realized with the coupling network configuration of FIG. 7. This energy loss is due to the coupling of energy to the matched terminations 83*a* through 83*d*.

Though only the coupling of signals from input port 51 to output ports 54,55 and 56 was described above, the configuration of the network 33 allows this operation to be permutated so that the above description is applicable to the coupling between any input port, the output port directly coupled thereto, and the output ports adjacent to the directly coupled output port thus providing a complete description of the network 33.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A scanning antenna system comprising:

input means for receiving electromagnetic signals;

reflector means disposed about an axis for reflecting electromagnetic signals incident thereto from a focal region thereof located in a focal plane substantially perpendicular to said axis said reflections being along paths substantially perpendicular to said axis thereby forming a beam in space;

means positioned in said focal plane for illuminating said reflector means with said incident electromagnetic signals; and means coupled between said input means and said illuminating means for selectively coupling electromagnetic signals to sections of said illuminating means, thereby illuminating selected sections of said reflecting means with incident electromagnetic signals, causing said formed beams to scan over predetermined angular sectors.

2. A scanning antenna system in accordance with claim 1 wherein said reflector means comprises a plurality of reflecting rods arranged on a surface defined by a truncated cone such that each forms an angle of 45 degrees with said axis, said truncated cone having a central circle tangential to an imaginary sphere at a preselected elevation angle and approximates an annulus thereof, said sphere having a diameter substantially coincident with said axis and an equatorial plane substantially coincident with said focal plane.

3. A scanning antenna system in accordance with claim 1 wherein said reflector means comprises reflecting material positioned over a predetermined sector of a truncated cone having a central circle tangential to an imaginary sphere at a preselected elevation angle and approximates an annulus thereof, said sphere having, a diameter substantially coincident with said axis and an equatorial plane substantially coincident with of said focal plane.

4. A scanning antenna system in accordance with claims 1 or 2 wherein said illuminating means comprises a plurality of antenna elements and said selective coupling means comprises a corresponding plurality of switch elements for switchably coupling signals from said input means to selected antenna elements such that selected sectors of said truncated cone are illuminated to radiate electromagnetic beams in selected angular regions.

5. A scanning antenna system in accordance with claim 4 wherein said selected antenna elements include three antenna elements, a central antenna element and two antenna elements adjacent thereto, coupled by said switch element to said input means in a manner to establish a predetermined amplitude and phase distribution therebetween.

6. A scanning antenna system in accordance with claim 5 wherein said selective coupling means further includes:

a plurality of input networks arranged such that each has a first adjacent input network and a second adjacent input network, each of said input networks possessing an input port coupled to one of said plurality of switch elements, an internal output port, and first and second external output ports, each input network constructed and arranged to possess a power coupling coefficient of T between said input port and said internal output port and a power coupling coefficient of R between said input port and first and second external output ports;

a plurality of output networks in correspondence with said plurality of input networks forming pairs of input and output networks, said output networks arranged such that each has a first and second adjacent output network, each of said output networks possessing an output port coupled to one of said plurality of antenna elements, an internal input port, and first and second external input ports, each output network constructed and arranged to possess a power coupling coefficient of T between said internal input port and said output port and a power coupling coefficient of 2R between said first and second external input ports and said output port, first means for coupling said internal output port of said input network to said internal input port of said corresponding output network; and second means for coupling said first external input port of said output network to said second external output port of said first adjacent input network, said second external input port of said output network to said first external output port of said second adjacent input network, said first external output port of said input network to said second external input port of said first adjacent output network, and said second external output port of said input network to said first external output port of of said second adjacent output network.

7. A scanning antenna system in accordance with claim 6 wherein said first coupling means comprises a transmission line of preselected electrical length and said second coupling means comprises:

first and second coupling networks each having first and second input ports and first and second output ports, each of said coupling networks constructed and arranged such that a signal coupled to said first input port is coupled to said second output port substantially unattenuated with substantially no signal energy coupled to said second input port and said first output port, said first and second coupling networks coupled between said plurality of input networks and said plurality of output networks with said second external output port of said first adjacent input network coupled to said first input port of said first coupling network, said first external output port of said input network coupled to said second input port of said first coupling network, said first output port of said first coupling network coupled to said second external input port of said first adjacent output network, said second output port of said first coupling network coupled to said first external input port of said output network, said second external output port of said input network coupled to said first input port of said second coupling network, said first external output port of said second adjacent input network coupled to said second input port of said second coupling network, said first output port of said second coupling network coupled to said second external input port of said output network, and said second output port of said second coupling network coupled to said first input port of said second adjacent output network.

8. A scanning antenna system in accordance with claim 7 wherein said input and output ports of said first and second coupling networks are coupled to said external output ports of said plurality of input networks and to said external input ports of said plurality of output networks respectively via transmission lines of substantially equal electrical length, said electrical length and said preselected electrical length of said transmission line comprising said first coupling means chosen to establish a desired phase distribution at said antenna elements coupled to said output ports of said output networks.

* * * * *